United States Patent [19]

Broach

[11] 4,120,248

[45] Oct. 17, 1978

[54] ILLUMINATED DECORATIVE TABLES

[76] Inventor: Ronald Broach, 1108 Franklin Ave., Apt. 2, Cincinnati, Ohio 45237

[21] Appl. No.: 634,453

[22] Filed: Nov. 24, 1975

[51] Int. Cl.[2] ..... A47B 85/00

[52] U.S. Cl. ..... 108/23

[58] Field of Search ..... 108/23, 139, 142, 150; 240/2 AD, 4, 2 R, 10.1

[56] References Cited

U.S. PATENT DOCUMENTS

| | | | |
|---|---|---|---|
| 1,676,108 | 7/1928 | Novak | 108/23 X |
| 1,989,869 | 2/1935 | Kohn | 108/139 X |
| 2,013,286 | 9/1935 | Naramore | 108/23 X |
| 2,605,386 | 7/1952 | Syretz | 240/10.1 |
| 3,028,482 | 4/1962 | Koehler | 240/10.1 |
| 3,038,474 | 3/1963 | Allen | 240/10.1 |
| 3,191,147 | 6/1965 | Majendie | 240/10.1 X |
| 3,245,163 | 4/1966 | Allen | 240/10.1 X |
| 3,247,609 | 4/1966 | Hayes et al. | 240/10.1 |
| 3,361,508 | 1/1968 | Chassevent | 108/23 X |
| 3,494,308 | 2/1970 | Perrin | 108/150 |
| 3,617,693 | 11/1971 | Shimosawa | 108/150 |
| 3,694,645 | 9/1972 | Brantz | 240/10.1 |
| 3,850,117 | 11/1974 | Martinelli | 108/150 |

FOREIGN PATENT DOCUMENTS

| | | | |
|---|---|---|---|
| 493,614 | 5/1950 | Belgium | 108/23 |

*Primary Examiner*—James T. McCall

[57] ABSTRACT

An illuminated decorative table is described. It comprises a circular transparent top supported by an apertured, star shaped disc. Certain apertures are illuminated by light bulbs that may be selectively turned on by a plurality of switches. Other apertures, in the points of the star are successively illuminated by a rotating switch which momentarily turns on light bulbs to give a sense of rotation to these illuminated apertures. The top and disc are rotatable relative to supporting legs.

8 Claims, 6 Drawing Figures

ILLUMINATED DECORATIVE TABLES

The present invention relates to improvements in illuminated, decorative tables.

While illuminated decorative tables are known in the prior art, there remains a need and commercial market for improved tables of this type particularly with regards to a table capable of giving relaxation as well as fascination to the persons sitting at the table or viewing it from a distance. Further, there is a need for tables of this type wherein the lighting may be selectively controlled to give a desired visual effect.

Accordingly, the primary object of the present invention is to provide an improved decorative table particularly adapted to giving a unique and unusual sense of motion to the illumination thereof.

Another object of the invention is to provide such an improved table in which the lighting patterns may be selectively actuated to provide controlled visual effects.

Another object of the invention is to provide an illuminated table of the above type in which the table's top itself may be resolved both for the convenience of people sitting beside it or using it as well as to control the position of the visual effects of the table.

These ends are fulfilled, in the broader aspects of the invention, by a decorative table comprising a horizontally disposed top unit having spaced, upwardly directed, light transmitting portions. These illuminating means are sequentially and momentarily actuated to provide a sense of movement to the light transmitted through the top unit.

Preferably, the light transmitting portions of the top unit are disposed in a generally circular fashion and the actuating means actuate the illuminating means progressively around the light transmitting portions.

Other features of the invention are found in forming the top unit of a light transmitting top member and an underlying disc. Apertures formed in the disc define the upwardly directed light transmitting portions. Further apertures may be formed in the disc and illuminating chambers provided therebeneath. Light bulbs disposed in these chambers may be selectively actuated to control the illuminated pattern of the table provided by these further apertures. Additionally, the top unit may be rotatably mounted on supporting legs to enable its being positioned as desired.

The above and other related objects and features of the invention will be apparent from a reading of the following specifications, with reference to the accompanying drawings, and the novelty thereof pointed out in the appended claims.

Figure 1:
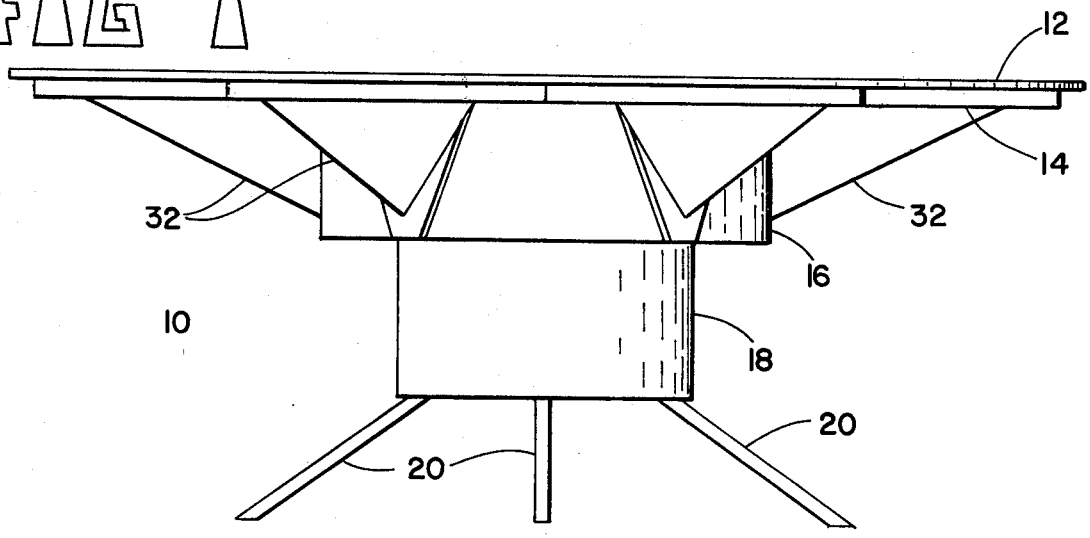
FIG. 1 is an elevation of a table embodying the present invention.

The table of the present invention is indicated generally by reference character 10 and comprises a transparent or translucent top 12 which may be formed of glass or an acrylic resin or other material commonly referenced as a plastic. The top 12 is supported by an underlying star shaped disc 14. Beneath the disc 14 are a pair of tubes 16 and 18. The assembly comprising the top 12 disc 14, tubes 16 and 18 is rotatably mounted on supporting legs 20 as will later be described in greater detail.

Figure 2:
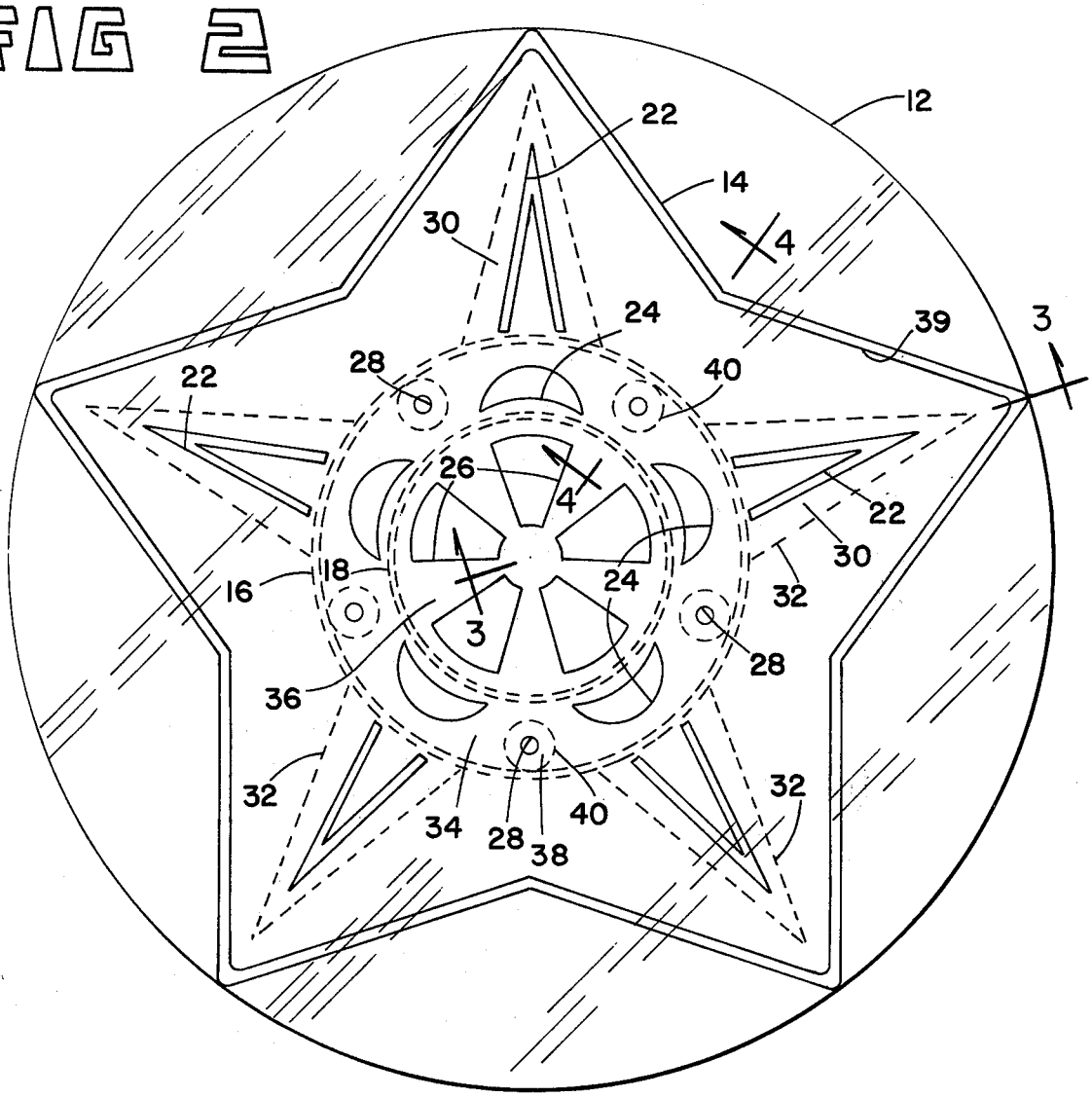
FIG. 2 is a plan view of the table seen in FIG. 1.

Referencing FIG. 2, it will be seen that there are a plurality of apertures formed in the disc 14. Aligned with the points of the star shaped configuration of the disc 14 are outer, V-shaped apertures 22, intermediate, crescent shaped apertures 24 and inner segment shaped apertures 26. Intermediate the crescent shaped apertures 24 are circular apertures 28. The disc 14 has a raised peripheral lip 39 which supports the top member in spaced relation to the apertured portion of the disc to minimize heat in the top member. The top member 12 and the disc 14 combine to form a top unit having spaced, upwardly directed, light transmitting portions.

Separate illuminating chambers 30 are formed beneath each of the V-shaped apertures 22 by V-shaped housings 32 which are secured to the outer surface of the tube 16. The crescent shaped openings are provided therebeneath with an illuminating chamber 34 which is defined by the tubes 16 and 18. The apertures 26 are provided with an illuminating chamber 36 which is defined by the inner surface of the tube 18. Separate illuminating chambers 38 are provided for the apertures 28 by tubes 40 mounted on the inner wall of the tube 16.

As will be later explained in detail electric light bulbs mounted in the chambers 34, 36 and 38 may be selectively actuated to provide a control of upwardly directed light patterns from the table surface. Bulbs of different colors may be employed to enhance the aesthetic effect provided. Further electric light bulbs in the chambers 32 are successively illuminated to give a sense of rotation to the upwardly directed light pattern from the outer, V-shaped apertures 22. All of this combines to give a highly pleasing and aesthetic visual effect.

Figure 3:
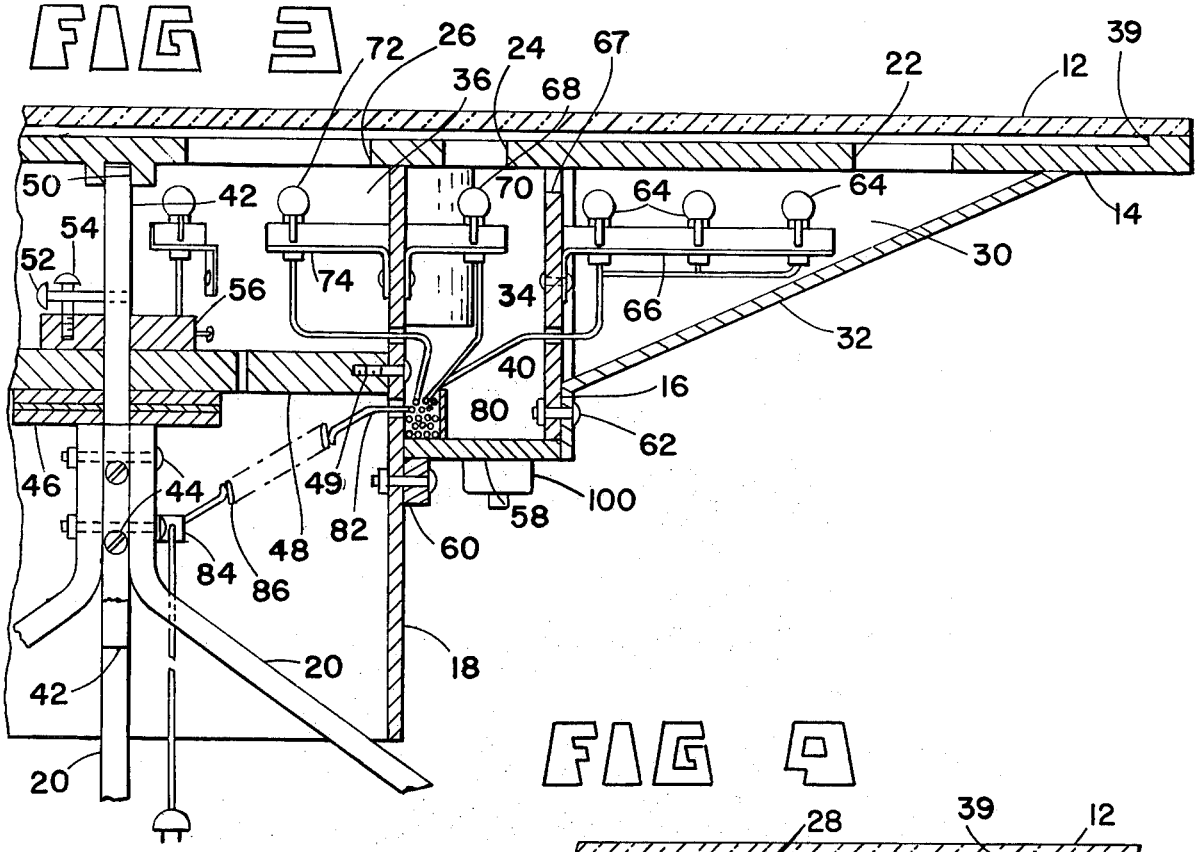
FIG. 3 is a section, on an enlarged scale, taken on line 3—3 in FIG. 2.

FIG. 3 shows in greater detail the constructural features of the invention. The upper end portions of the supporting legs 20 are bent to upright positions and are secured to a vertical pipe or shaft 42 by screws 44. A rotary thrust bearing 46 is supported by the upper ends of the legs 20. A disc 48 is secured to the inner surface of the inner tube 18 by screws 49. The disc 48 is supported by the upper member of the thrust bearing 46 and rotates relative to the bottom member. The shaft 42 extends upwardly to a recess 50 in the lower surface of the disc 14. This provides stability for the rotatable assembly which comprises the top member 12 disc 14 tubes 16 and 18 and the remainder of the assembly attached to these elements. Rotation of this assembly is limited to approximately 360° by a screw 52 projecting from the shaft 42 and engagably with a top 54 secured to a hub 56 of the disc 48.

An annular disc is telescoped over the outer surface of the tube 18 and is supported by lugs 60 fastened on that tube. The outer tube 16 rests on and is supported by the annular disc 58. Each housing 32 is then secured to the outer surface of the tube 16 by a bolt 62.

Within the several illuminating chambers are electric light Bulbs which will now be described. The light bulbs may be of the low wattage type commonly employed in decorating Christmas trees. The same type of socket used for Christmas tree decoration may be employed. These sockets have a spring clip which enables their mounting as will be apparent from the following description.

Three bulbs 64 are mounted in each of the illuminating chambers 30. Brackets 66 are secured to the outer wall of the tube 16 and project into the respective chambers 30 enabling the clips of the bulb sockets to be positioned thereon. Optionally, slots 67 may be formed in the upper portion of the tube 16 to provide limited light communication from the illuminating chambers 30 into the adjacent illuminating chamber 34 and provide for a diffusion of lighting between these chambers.

The illuminating chamber 34 is closed at its lower end by the annular disc 58. Bulbs 68 are mounted in the illuminating chamber 34 by clipping their sockets to brackets 70 secured to the outer surface of the tube 18. Similarly, bulbs 72 are mounted in the illuminating chamber 36 by clipping their sockets to a bracket 74 secured to the inner surface of the tube 18. It will be seen also thatthe disc 48 closes off the lower end of the illuminating chamber 36.

Figure 4:
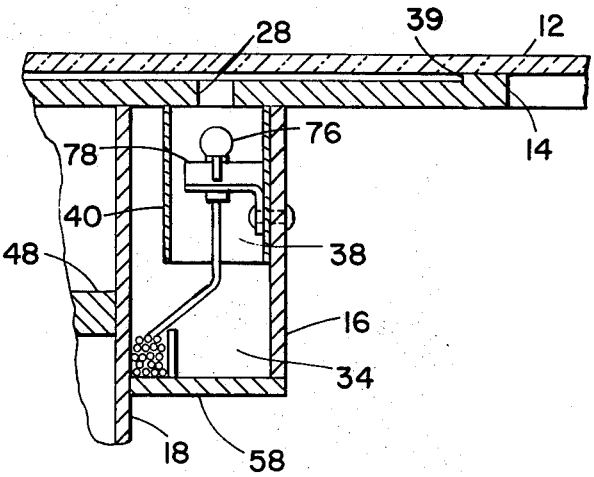
FIG. 4 is a section, on an enlarged scale, taken on line 4—4 in FIG. 2.

Referencing FIG. 4 it will be seen that each tube 40 defining the illuminating chambers 38 is mounted on the inner surface of the tube 16. A bulb 76 is mounted within each tube 40 by being clipped to a bracket 78, secured to the tube 16 by the bolt which secures the latter to the tube 16.

Holes in the disc 48 and tubes 16 and 18 provide for air circulation in the several illuminating chambers.

The wires which carry current to the several bulbs in the various illuminating chambers are fed through appropriate openings in the tubes 16, 18 and the bottom wall of the tube 40 and extend to a wiring harness 80. This wiring harness is connected to an electric cord 82 which is anchored by a clamp 84 mounted on one of the supporting legs 20. The electrical cord has a connector which may be connected to an appropriate source of current. It will also be seen that the cord 82 has a coiled extension portion 86 which enables the table to be rotated without having the cord becoming tangled.

Figure 5:
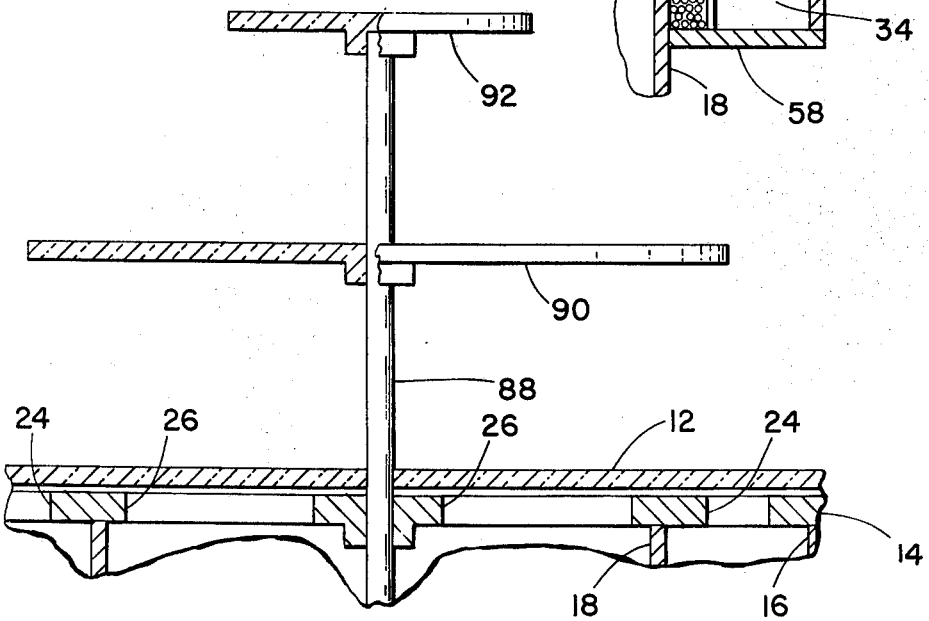
FIG. 5 is a fragmentary elevation, partly in section, of a modified embodiment of the invention.

Reference is next made to FIG. 5 for a description of a modification of the present invention. It will there be seen that a shaft 88, which otherwise serves the functions of the previously described shaft 42, extends through openings in the disc 14 and the top 12 and has secured thereto discs 90 and 92 which serve as shelves for the convenience of those sitting at the table. Preferably, these shelves 90 and 92 are also formed of transparent material to compliment the visual effect provided by the illuminated apertures.

Figure 6:
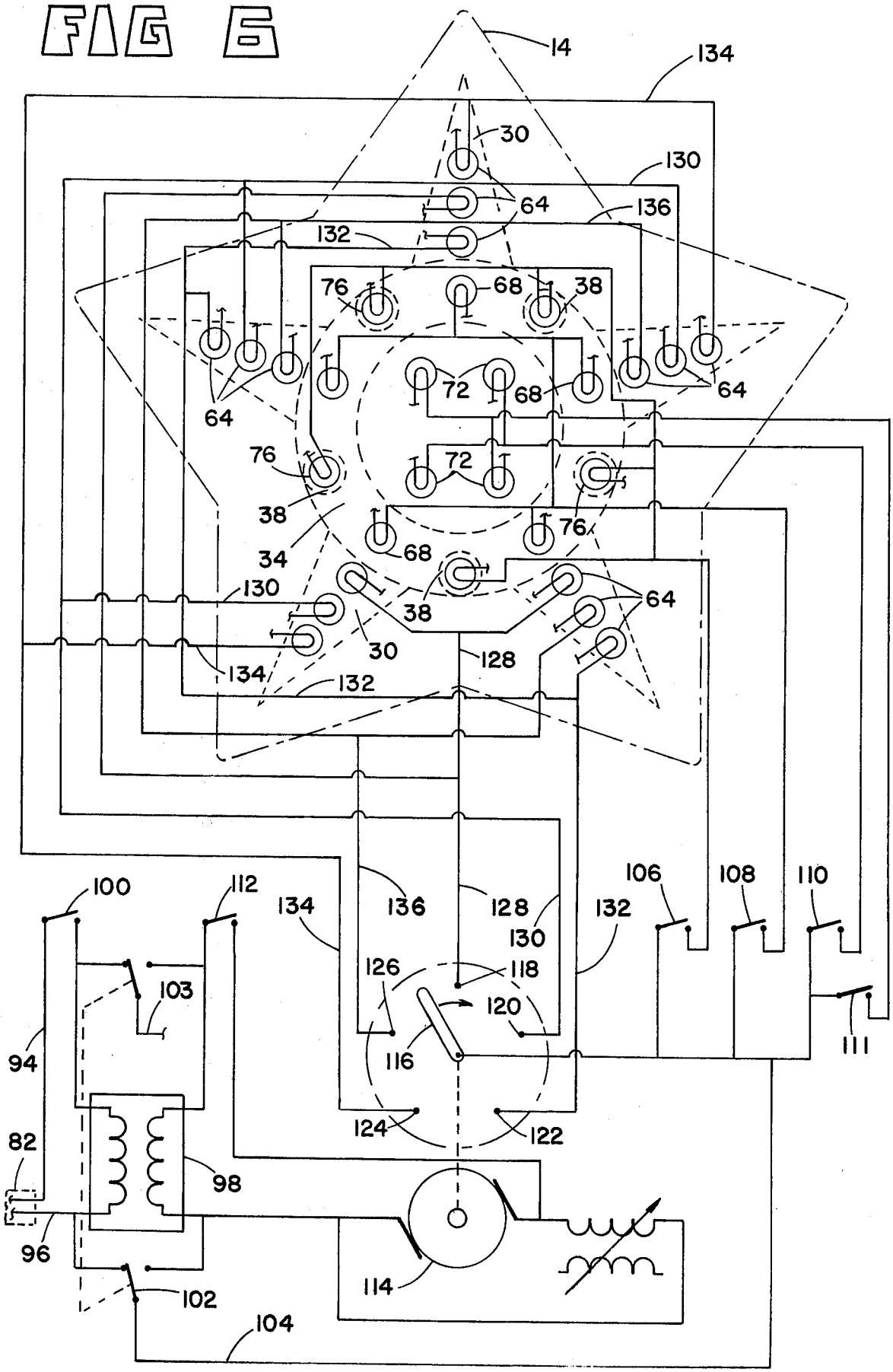
FIG. 6 is a schematic of an electrical circuit employed in the present invention.

Referring now to FIG. 6, a description of the electrical circuit employed herein will be given. The electric cord 82 comprises electrical leads 94 and 96 which in turn would be connected to an appropriate source of alternating current. These leads are connected across the primary of a transformer 98 by closing of a switch 100. A ganged switch 102 is provided to selectively connect, as will later appear, the electric bulbs in the several illuminating chambers across either the primary or secondary of the transformer 98. This enables the intensity of the illuminated pattern to be varied for aesthetic purposes or otherwise.

Lead 103 of the switch 102 is connected to one side of the filament of each of the several electric bulbs employed herein. For sake of clarity and simplicity, these connections are omitted. Lead 104 from the other side of the switch 102 is then connected to the other side of the several electric bulbs through switching means now to be described.

Illumination of the chamber 34 is controlled by switch 108. Closing of this switch completes the circuit across the bulbs 68 to provide illumination for the apertures 24. Illumination of the chambers 38 is controlled by switch 106 which may be closed to complete the electrical circuit across the bulbs 76 and provide for illumination of the apertures 28.

Illumination of the chamber 36 is controlled by switches 110 and 111. Switch 110 is connected to two of the bulbs 72 disposed within the chamber 36 and switch 111 may be closed to complete the circuit across the other two bulbs in the chamber 36. This gives further control of the intensity of light in the chamber 36. Additionally, by having the bulbs controlled by the switch 110 of a different color than the bulbs controlled by the switch 111, it is possible to vary the color of light transmitted from the apertures 26.

The chambers 30 are illuminated upon closure of a switch 112. This completes a circuit to a varible speed motor 114 across the low voltage output of the transformer 98. The output shaft of the motor 114 is mechanically connected to and rotates a contact arm 116 which is electrically connected to the lead 104. The contact arm 116 sequentially makes electrical contact with contact points 118, 120, 122, 124 and 126, which respectively have output leads 128, 130, 132, 134 and 136. These last mentioned leads are respectively connected to one side of the filaments of three of the bulbs 64. Specifically each of these leads is connected to one side of the filaments of the bulbs 64 in adjacent points of the star configuration and in the opposite or remote point of the star. Thus, the lead 128 is connected to one of the bulbs in each of the lower points of the star and to a bulb 64 in the upper point of the star. The lead 130 is connected to a bulb 64 in the lower left point of the star and the upper left point of the star and to a bulb in the upper right point of the star. Lead 132 is connected to the adjacent upper left and top points of the star and to a bulb 64 in the lower right point of the star. Lead 134 is connected to a bulb in the upper point of the star and to a bulb in the right point of the star and to the remote bulb in the lower left point of the star. Finally, lead 136 is connected to a bulb 64 in the upper right point of the star and bulb in the lower right point of the star and a bulb in the upper left point of the star.

It will be apparent that upon rotation of the contact arm 116 three points of the star, in triangular arrangement, are illuminated, in a sequential fashion. This gives a sense of rotary movement to the illumination of the apertures 22 and a diffused sense of rotary-like movement in the illumination of the apertures 24 by reason of the slots 67 (FIG. 3) which provide a light communication between the chambers 30 and 34. The rate of this movement may be varied through the setting of the variable speed motor 114 to control the aesthetic effect.

It is contemplated that different colored light bulbs would be employed in the various chambers and also that the bulbs 64 be of different colors to further enhance the aesthetic effect of the present illuminated table.

The transformer 98, motor 114 and rotary switch 116 may be physically located in the illuminating chamber 34 by mounting these elements on the annular disc 58. The switches 100, 102, 112, 106, 108, 110 and 111 may be physically mounted on the lower surface of the annular disc 58 where they will be readily accessable for actuation. For sake of illustration, the switch 100 only is shown in FIG. 3. The several switches and other components of the circuit would have their wires also included in the wiring harness 80.

While the embodiment described is preferred and provides a highly aesthetic decorative table, many variations therefrom within the scope of the broader aspects of the invention will occur to those skilled in the art. For example other types of electric light bulbs or other light sources could be employed. The motor 114 which enables the rate of rotation of the illumination of the chambers 30 to be varied as desired could be of the incrementally variable type rather than infinately variable. Likewise, in connection with the electrical circuit a direct current potential could be employed and battery operation is entirely possible, also oscillating current.

Further, the number of lights used could be changed as well as the configuration and number of the various apertures which provide the visual design effect of the table. Also, the tube 18 and the disc 48 which define the illuminating chamber 36 could be formed of a plastic resin and be molded in one piece.

These and other variations in the described embodiment of the invention are therefore to be deemed within the spirit and scope of the invention which is to be determined solely by the following claims.

Having thus described the invention, what is claimed as novel and desired to be secured by Letters Patent of the U.S. is:

1. A decorative table comprising a horizontally disposed light transmitting top unit, said top unit including an upper planar surface and an underlying planar disc having patterned light transmitting portions, a plurality of illuminating means disposed and attached to a supporting disc, beneath said top unit for illuminating the respective light transmitting portions, a powered means for sequentially and momentarily actuating said illuminating means, and a floor engaging support means having a supporting shaft extending upwardly from said support means engaging and supporting said top unit and said illuminating means.

2. A decorative table as in claim 1 wherein the light transmitting portions of the top unit are disposed in a generally circular fashion and the actuating means actuate the illuminating means progressively around the light transmitting portions.

3. A decorative table as in claim 2 wherein the top unit comprises a light transmitting top member and an underlying disc and said disc has apertures therein to define the upwardly directed, light transmitting portions, and the illuminating means comprise, chamber means beneath the apertures and electric light bulbs disposed in the chamber means, and the actuating means include a rotating switch element sequentially and momentarily connecting said bulbs across an electrical potential.

4. A decorative table as in claim 3 further comprising supporting legs and wherein the top unit and illuminating chambers are rotatably mounted with respect to said supporting legs.

5. A decorative table as in claim 4 wherein a shaft extends upwardly from said legs above the level of said light transmitting top, and shelf means supported from said shaft in spaced relation above said top.

6. A decorative table as in claim 4 wherein the top is circular in outline and the underlying disc is star shaped in outline and further wherein at least some of the disc apertures are aligned with the points of the star shaped outline.

7. A decorative table as in claim 6 wherein separate V-shaped chambers are disposed beneath the outer apertures in the disc, a plurality of bulbs is disposed in each of the V-shaped chambers, the rotating element connects a bulb in a plurality of the V-shaped chambers across the electrical potential.

8. A decorative table as in claim 7 wherein the disc has a five pointed star shaped outline, a light transmitting channel is provided between each V-shaped chamber and the next adjacent illuminating chamber, each connection made by the rotating switch element connects bulbs in two adjacent chambers and a bulb in a remote V-shaped chamber across the electrical potential, means are provided for varying the rate of rotation of the rotating switch element, and in one of the further illuminating chambers, separate illuminating chambers having electric light bulbs therein are provided beneath further apertures in said disc, and further wherein the disc has a peripheral bead supporting the top in spaced relation therefrom.

* * * * *